United States Patent [19]

Rattay

[11] 4,319,727

[45] Mar. 16, 1982

[54] EXPANDABLE POT HOLDER APPARATUS

[76] Inventor: Joan H. Rattay, 749 E. Maryland Ave., Phoenix, Ariz. 85014

[21] Appl. No.: 117,191

[22] Filed: Jan. 17, 1980

[51] Int. Cl.[3] ..... A47G 23/02

[52] U.S. Cl. ..... 248/149; 248/172

[58] Field of Search ..... 248/146, 149, 172, 310, 248/188.7, 188, 188.8; 108/156; D6/196, 183, 176, 178

[56] References Cited

U.S. PATENT DOCUMENTS

| | | | |
|---|---|---|---|
| 837,388 | 12/1906 | Curial | 248/149 X |
| 1,396,445 | 11/1921 | Loudon | 248/154 |
| 1,495,991 | 6/1924 | Drynan | 248/172 |
| 2,210,047 | 8/1940 | Stieglitz | 108/156 |
| 4,033,653 | 7/1977 | Doring et al. | 248/188 X |

*Primary Examiner*—Ernest R. Purser

*Attorney, Agent, or Firm*—H. Gordon Shields

[57] ABSTRACT

An expandable pot holder includes a base ring and three movable supports for the base ring, with the three supports movable radially inwardly and outwardly to support pots of various sizes.

7 Claims, 7 Drawing Figures

EXPANDABLE POT HOLDER APPARATUS

BACKGROUND OF THE INVENTION

1. Field of the Invention

This invention relates to pot holders and, more particularly, to pot holders capable of expanding and contracting for supporting pots of various sizes.

2. Description of the Prior Art

U.S. Pat. No. 837,388 discloses one form of an expandable pot holder. The pot holder includes a base ring to which are secured four movable arms. The movable arms include distal, tip portions which provide support for a pot. The arms are secured to the base ring at a fixed position and pivot relative to the base ring to increase or decrease their overall size for supporting pots of different sizes.

U.S. Pat. No. 874,071 discloses another type of pot holder in which three legs are secured to a central ring and the legs move radially inwardly and outwardly with respect to the ring to accommodate pots of various sizes. The center ring does not provide support for a pot, rather only the distal tips of the legs provide support for a pot.

U.S. Pat. No. 1,155,383 discloses another form of adjustable support which includes a pair of plates disposed adjacent each other and four legs secured to one of the plates. One plate moves relative to the other plate, and includes a plurality of slots through which extend pins which are secured to the legs. The slots are disposed in angular relationship with respect to each other and are curved in configuration. As the movable plate rotates, the pins move in the slots to cause the legs to move inwardly and outwardly. Jaws secured to the legs are used to clamp and hold an object as the legs move inwardly.

U.S. Pat. No. 1,396,445 discloses a plant stand which includes a telescoping tubular post secured to a fixed base and an upper support for a flower pot. The flower pot stand pivots on the tubular support and is adjustable by four telescoping arms which move radially inwardly and outwardly. Pads on the movable portion of the arms provide the support for flower pots, and the pads include vertically extending arms which provide vertical external support for holding the flower pot, particularly as the stand is pivoted.

U.S. Pat. No. 1,481,137 discloses a different type of flower pot support in which the legs telescope vertically and also telescope radially. The stand thus is adjustable in both height and diameter. Pads at the tops of the legs provide support for the flower pot.

U.S. Pat. No. 1,495,991 discloses a stand in which several legs are secured to a plate through arcuate slots. The slots allow the legs to be moved to vary the diameter of the holder. The legs include platform elements which provide support for a pot.

U.S. Pat. No. 1,739,588 discloses a holder for a pot or a garbage can. The holder includes a plurality of vertically extending arms secured to a circular base. The pot or garbage can is disposed on the base and within the vertically extending arms.

U.S. Pat. No. 2,679,996 discloses a garbage can holder with a plurality of vertically extending arms that are individually secured to legs. The legs are in turn adapted to be secured or driven into the ground. The arms are individually adjustable relative to the legs to support cans of various diameters within the arms.

U.S. Pat. No. 2,931,604 discloses a Christmas tree stand which is vertically adjustable with respect to a fixed base. The stand includes a central ring which is movable relative to the arms in the fixed base. Adjustment of the arms is accomplished by means of slots that secure the center ring to the base.

SUMMARY OF THE INVENTION

The invention described and claimed herein comprises an adjustable stand for a flower pot or the like and the stand includes a base ring which provides support for the pot and three legs which move radially with respect to the base ring. The legs each include an upper portion which also provides support for the pot along with the base ring.

Among the objects of the invention are the following:

To provide new and useful pot holder apparatus;

To provide new and useful adjustable pot holder apparatus;

To provide new and useful pot holder apparatus which includes a base ring and a plurality of legs;

To provide new and useful pot holder apparatus having legs movable inwardly and outwardly to fit the diameter of a pot;

To provide new and useful holder apparatus which allows drainage from a flower pot;

To provide new and useful adjustable apparatus for supporting pots;

To provide new and useful apparatus for holding pots of various sizes; and

To provide new and useful apparatus for supporting a pot on a center ring and on a plurality of legs secured to the center ring.

DESCRIPTION OF THE PREFERRED EMBODIMENT

Figure 1:
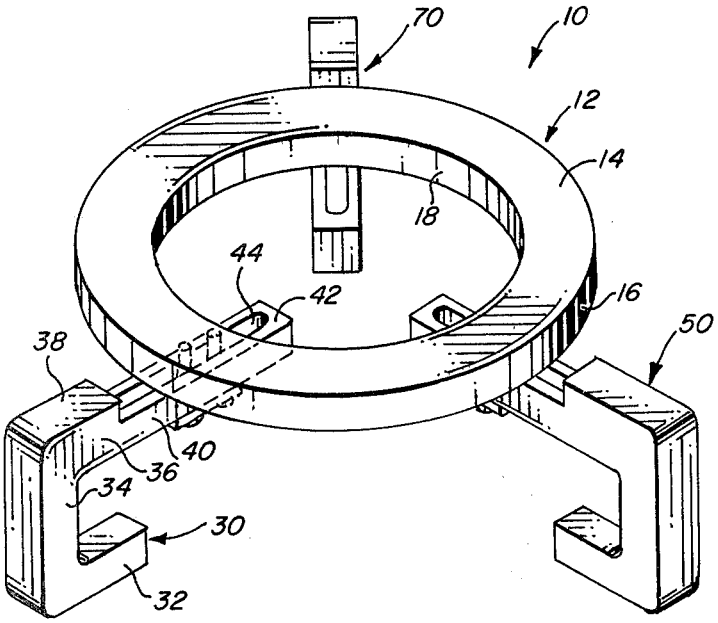
FIG. 1 is a perspective view of the pot holder apparatus of the present invention.
Figure 3:
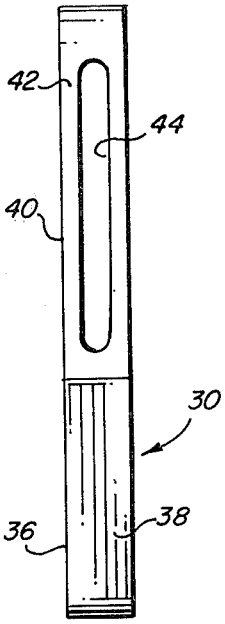
FIG. 3 is a top view of a portion of the apparatus of the present invention.
Figure 2:
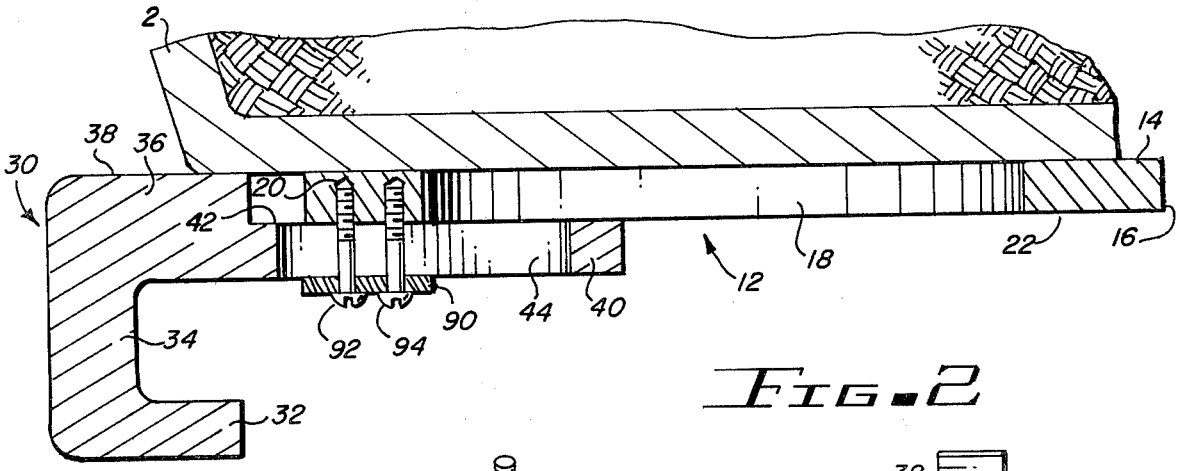
FIG. 2 is a view in partial section of the apparatus of FIG. 1.
Figure 4:
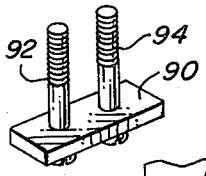
FIG. 4 is a perspective view of fasteners used to secure together elements of the present invention.
Figure 5A:
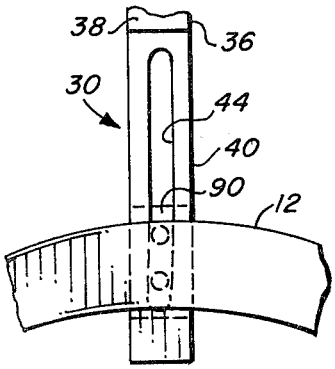
FIGS. 5A, 5B, and 5C comprise top views of a portion of the apparatus of the present invention illustrating the adjustability of the apparatus for supporting pots of various sizes.
Figure 5B:
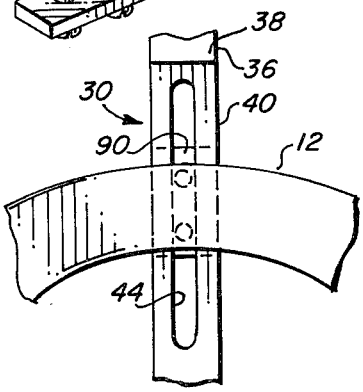
Figure 5C:
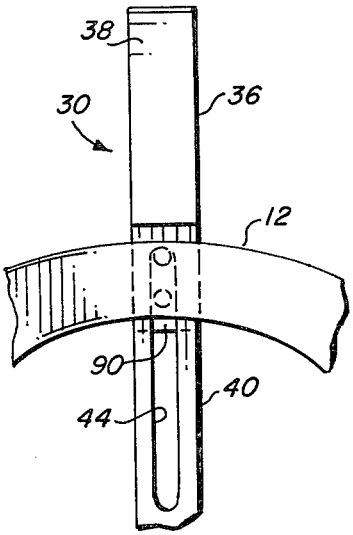

FIG. 1 comprises a perspective view of expandable pot holder apparatus 10. The pot holder apparatus 10 includes a base of central ring 12 to which are secured three base supports or legs 30, 50, and 70. FIG. 2 is a view in partial section of the pot holder 10 taken generally through the center or base ring 12 and through the base support or leg 30. FIG. 3 is a top view of the leg 30. FIG. 4 is a view in partial section of the fasteners used to secure the base supports or legs to the ring 12. FIGS. 5A, 5B, and 5C illustrate the expansion and contraction of the pot holder apparatus 10. They comprise top views of a portion of the ring 12 and of the leg 30 as it moves relative to the ring 12. The following discussion of the apparatus 10 will include reference to all of the Figures of the drawing.

The base ring 12 is a generally circular ring which includes a top surface 14 and a bottom surface 22. An outer peripheral surface 12 extends between the top surface and the bottom surface at the outer periphery of the ring. An inner peripheral surface 18 is disposed generally parallel to the outer peripheral surface 16 and spaced apart therefrom by the width of the top surface 14 and the bottom surface 22. The ring 12 is preferably solid for providing support for a pot, such as a pot 2, a portion of which is shown in FIG. 2 disposed on the apparatus 10.

The size of the ring 12 may vary, depending on the general size or type of pot which the apparatus 10 will be used with. The width of the ring, that is, the difference between the inner diameter and outer diameter, or between the inner and outer peripheral surfaces, may also vary, as desired. The top surface 14 provides support for a pot, and accordingly should be of sufficient width to conveniently fit with the type of pots which may be used with the apparatus.

Furthermore, the width of the ring, or the distance between the inner and outer peripheral surfaces, should be of sufficient width to allow the base supports or legs to be secured thereto. For the purpose of securing the legs or base supports to the ring 20, the ring 20 includes three pairs of tapped apertures 20. The tapped apertures are radially aligned with each other and the pairs are spaced apart from each other about one hundred twenty degrees, thus orienting the three legs at one hundred twenty degree intervals with respect to each other. The legs 30, 50, and 70 are shown in FIG. 1 as being disposed generally one hundred twenty degrees apart and secured to the ring 12 at the lower or bottom surface 22 of the base ring. The tapped apertures 20 accordingly extend upwardly from the bottom surface 22 and into the base ring 12.

Three legs or supports are used for at least two reasons. First, three points define a plane, and accordingly the three legs provide a sturdy base for the apparatus. Second, the three legs, with their one hundred twenty degree spacing, provide ample room for the insertion of a water collector cup beneath the ring 12, and beneath a pot disposed thereon, for drainage purposes. The cup or pot or bowl, or whatever is used, may be of any convenient size, as desired.

The three base supports or legs 30, 50, and 70 are substantially identical, and accordingly only the leg 30 will be discussed in detail. The base support or leg 30 includes a lower horizontally extending arm portion 32. The horizontal arm 32 comprises a foot to provide stability for the apparatus 10. From one end of the lower horizontal arm 32 a vertical arm portion 34 extends upwardly, substantially perpendicular to the lower arm 32. Extending generally parallel to the lower horizontal arm 32, and secured to the vertical arm 34, is an upper horizontal arm 36. The upper horizontal arm 36 includes an upper surface 38. When the base support 30 is secured to the ring 12, the upper surface 38 is generally aligned with the same plane as the upper surface 14 of the ring 12. The upper surface 38 accordingly provides or defines an additional support surface for the pot holder 10. This is shown in FIG. 4. A portion of the pot 2 is shown in FIG. 4 disposed on the top or upper surface 38 of the leg 30 as well as on the top or upper surface 14 of the base ring 12, showing the co-planar aspect of the surfaces 38 and 14.

Extending inwardly from the upper horizontal arm 36 is an extension support arm 30. The extension support arm 40 includes an upper surface 42 which is generally parallel to the upper surface 38 of the upper horizontal arm 36, but disposed downwardly therefrom. The distance, vertically, between the upper surfaces 38 and 42 is substantially the same as the thickness of the ring 12. Accordingly, the ring 12 is disposed on the surface 42 and secured thereto to define a single plane for the top surfaces 14 of the ring 12 and 38 of the arm 36. The support arm 40 is an extension or continuation of the arm 36 which extends inwardly to cooperate with the ring 12 to secure the leg 30 and the ring 12 together.

The extension support arm 40 includes a slot 44 which extends vertically through the arm. The slot 44 is best shown in FIG. 3. The slot 44 is relatively narrow and is generally elongated to provide for the securing of the leg 30 to the ring 12 over virtually the entire length of the arm 40. The width of the slot 44 is sufficient to accommodate the width of a fastener, such as a screw 92. A pair of screws 92 and 94 are shown aligned with each other and extended through the slot 44 and secured to the tapped apertures 20 in the ring 12.

A flat washer 90 is shown in FIG. 4 with the screws 92 and 94 extending through a pair of holes or apertures in the washer 90. The width of the washer 90 is about the same as the width of the base support 30, which is preferably of a uniform width. That is, the several portions of the base support 30, including the lower horizontal arm 32, the vertical arm 34, the upper horizontal arm 36 and the extension support arm 40 are preferably of the same width. The width of the washer 90 accordingly is about the same width in order to give maximum support for the screws 92 and 94 as they extend through the slot 44 and into the tapped apertures 20 of the ring 12. The width of the washer 90 obviously must be greater than the width of the slot 44, and preferably overlaps substantially on the lower surface of the extension support arm 40 in order to provide maximum strength and support for securing the leg 30 to the ring 12. The function of the washer 90, the screws 92 and 94, with respect to the ring 12 and to the leg 30 are best shown in FIG. 2.

In FIG. 2, the pot 2 is shown disposed on the upper surface 14 of the ring 12. The outer periphery of the bottom of the pot 2 is also disposed on the top surface 38 of the base support or leg 30. Thus, both the ring 12, which is of a fixed, predetermined diameter or size, and the upper surface 38 of the leg 30 provide support for the pot disposed on the apparatus 10. Since the orientation of the surface 38 of the leg 30 may be adjusted radially relative to the ring 12; the upper surface 38, and the corresponding upper surfaces of the legs 50 and 70, may be disposed or oriented as required, depending on the size of the pot to be used with the holder apparatus 10. With respect to the size of a particular pot used with the apparatus 10, it will be understood that the diameter of the bottom, or bottom surface, of such pot is determinative with respect to the positioning of the legs radially with respect to the ring 12. Thus, as shown in FIG. 2, a portion of the bottom of the pot 2 is disposed on the upper surface 38 of the leg 30 as well as on the upper surface 14 of the ring 12.

The positioning of the leg 30 with respect to the ring 12 is illustrated sequentially in FIGS. 5A, 5B, and 5C. The major diameter of the pot holder 10 is at its maximum in FIG. 5A, in which the upper surface 38 of the upper horizontal arm 36 is at a maximum distance away from the ring 12. The washer 90, with its screws 92 and 94, are shown positioned at the inner end of the slot 44. With all of the legs positioned as shown in FIG. 5A, with respect to the ring 12, a pot of maximum bottom diameter may be supported on the holder apparatus 10.

In such an orientation, the ring 12 provides support for the bottom of a pot and the upper surfaces of the upper horizontal arms also provide support for a pot.

FIG. 5B illustrates the intermediate positioning of the leg 30 with respect to the ring 12. The ring 12 is disposed at about the mid point with respect to the slot 44. The washer 90 is positioned beneath the horizontally extending extension support arm 40, with the screws 92 and 94 used to secure the leg 30 to the ring 12. The overall diameter of the apparatus 10 is, with respect to FIGS. 5A, 5B, and 5C, of an intermediate size, between the maximum size as shown in FIG. 5A and a minimum size as shown in FIG. 5C.

In FIG. 5C, the ring 12 is disposed at the end of the slot 44 adjacent the upper horizontal arm 36 of the base support 30. In the position shown in FIG. 5C, the overall diameter of the apparatus 10 is a minimum, with the upper surface 38 of the upper arm 36 disposed adjacent the ring 12 so as to provide support for a pot immediately adjacent the upper surface 14 of the ring 12.

It will be understood that the three legs 30, 50, and 70 may be positioned as desired with respect to the ring 12 to provide a relatively wide range of diameters for supporting a pot. The examples of FIGS. 5A, 5B, and 5C illustrate simply three positions, a maximum overall diameter position, a middle or intermediate overall diameter position, and a minimum overall diameter position. The variation in sizes is limited only by the length of the slot 44 in the extension support arm 40 for the base support or leg 30, and by the corresponding elements of the base supports 50 and 70, which, together with the base support or leg 30, comprise the three legs for the apparatus 10.

Since the three legs are independently movable, it will be understood that an assymetrical flower pot may also be disposed on the stand 10, with the three legs adjusted as desired to provide appropriate support for such assymetrical flower pot. Any leg may be positioned as desired with respect to the ring 12 and to a pot disposed thereon in order to provide the appropriate support for the pot. Accordingly, the use of the apparatus 10 is not limited to a round flower pot, but a pot having an oval configuration, etc., may be disposed thereon and may be accordingly appropriately supported.

It will also be understood that the length or height of the vertical arm 34 of the leg 30, and the corresponding vertical arms of the leg or base supports 50 and 70 may be of any suitable length, as desired. Furthermore, the length of the lower horizontal arm 32 of the leg 30, and the corresponding horizontal arms of the other two supports 50 and 70 may also be of any length desired to provide the proper base support for the apparatus.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Pot holder apparatus, comprising in combination:

ring means for supporting a pot, including a ring having an upper surface on which the pot is disposed, and a lower surface;

aperture means extending upwardly from the lower surface of the ring means;

leg means adjustably secured to the ring means for supporting the ring means and comprising a plurality of base supports, each of which base supports includes a lower portion, a vertically extending portion, an upper portion having an upper surface co-planar with the upper surface of the ring means for providing an additional surface on which the pot is disposed, and an upper horizontally extending support portion disposed against the ring means; and fastening means cooperating with the aperture means for securing the leg means to the ring means.

2. The apparatus of claim 1 in which the aperture means includes a plurality of tapped apertures cooperating with the fastening means for securing the leg means to the ring means.

3. The apparatus of claim 2 in which the fastening means includes screw means extending through the leg means and into the tapped apertures for securing the leg means to the ring means.

4. The apparatus of claim 1 in which the lower portion of the leg means comprises a lower horizontally extending portion for providing stability for the pot holder apparatus.

5. The apparatus of claim 4 in which the lower horizontal portion of the leg means is disposed substantially parallel to the upper horizontally extending support portion of the leg means.

6. The apparatus of claim 4 in which the upper horizontally extending support portion comprises an arm having an upper surface disposed against the lower surface of the ring means, a lower surface, and a slot extending through the arm between the upper surface and the lower surface for cooperating with the fastening means for adjustably securing the arm to the ring means.

7. The apparatus of claim 6 in which the fastening means includes a washer disposed against the lower surface of the arm, a screw disposed against the washer and extending through the slot and into the ring means for securing the leg means to the ring means.

* * * * *